US010064451B2

(12) United States Patent
Dinel et al.

(10) Patent No.: US 10,064,451 B2
(45) Date of Patent: Sep. 4, 2018

(54) FOOTWEAR FORMING DEVICE

(71) Applicant: NIKE, Inc., Beaverton, OR (US)

(72) Inventors: Darryl Keith Dinel, Ho Chi Minh (VN); Anh Tu Hoang, Ho Chi Minh (VN); Steven Ploem, Bangkok (TH)

(73) Assignee: NIKE, Inc., Beaverton, OR (US)

( * ) Notice: Subject to any disclaimer, the term of this patent is extended or adjusted under 35 U.S.C. 154(b) by 34 days.

(21) Appl. No.: 15/173,243

(22) Filed: Jun. 3, 2016

(65) Prior Publication Data

US 2016/0353844 A1 Dec. 8, 2016

(51) Int. Cl.

| | |
|---|---|
| ***A43D 95/08*** | (2006.01) |
| ***A43D 95/12*** | (2006.01) |
| ***A43D 3/02*** | (2006.01) |
| ***A43D 95/02*** | (2006.01) |
| ***A43D 5/02*** | (2006.01) |

(52) U.S. Cl.

CPC ..... *A43D 95/08* (2013.01); *A43D 3/02* (2013.01); *A43D 5/02* (2013.01); *A43D 95/02* (2013.01); *A43D 95/12* (2013.01)

(58) Field of Classification Search

CPC ..... A43D 95/02; A43D 95/08; A43D 95/12
USPC ..... 12/53.3, 34, 34.5
See application file for complete search history.

(56) References Cited

U.S. PATENT DOCUMENTS

| | | | | | |
|---|---|---|---|---|---|
| 1,006,457 | A | | 10/1911 | Bayard | |
| 1,008,298 | A | * | 11/1911 | Ashton | A43D 49/00 12/53.3 |
| 1,486,801 | A | * | 3/1924 | Rousseau | A43D 89/00 12/103 |
| 2,365,795 | A | * | 12/1944 | Merwin | A43B 23/08 12/146 D |
| 2,911,214 | A | * | 11/1959 | Sherbrook | A43D 43/06 493/394 |
| 2,933,745 | A | * | 4/1960 | Slezak | A43D 95/00 12/53.3 |
| 3,384,912 | A | * | 5/1968 | Padovani | A43D 25/06 12/1 R |
| 2016/0353844 | A1 | | 12/2016 | Dinel et al. | |

FOREIGN PATENT DOCUMENTS

| | | | |
|---|---|---|---|
| EP | 0403720 | A1 | 12/1990 |
| TW | M541755 | U1 | 5/2017 |
| WO | 9956578 | A1 | 11/1999 |

OTHER PUBLICATIONS

International Search Report and Written Opinion dated Aug. 30, 2016 for International Patent Application No. PCT/US2016/035408, 13 pages.

International Preliminary Report on Patentability dated Dec. 14, 2017 in International Patent Application No. PCT/US2016/035408, 9 pages.

* cited by examiner

*Primary Examiner* — Ted Kavanaugh
(74) *Attorney, Agent, or Firm* — Shook, Hardy & Bacon, LLP

(57) ABSTRACT

Construction of a shoe relies on application of pressure to form the shoe portions to a desired shape and configuration. The application of pressure is accomplished with an adjustable width roller that conforms to different sizes of shoes while still contacting the shoe portion to conform the shape. Additionally, vibrational energy may be transmitted from the roller to the shoe portion to aid in the forming and shaping process of the shoe portion.

18 Claims, 9 Drawing Sheets

FOOTWEAR FORMING DEVICE

CROSS-REFERENCE TO RELATED APPLICATIONS

This application claims priority to pending Vietnam Application Number 1-2015-01986, filed Jun. 4, 2015, entitled "Footwear Forming Device," which is herein incorporated by reference in its entirety.

FIELD

Apparatus and methods for forming one or more portions of an article of footwear into a condition suitable for use as footwear.

BACKGROUND

A shoe may be formed around a cobbler's last. The materials of the shoe, such as the shoe upper materials, may be manipulated to cause them to assume a desired shape, such as a toe box. The manipulation may be done by hand in a laborious process that can cause fatigue to a worker performing the manipulation.

SUMMARY

Aspects of the present invention relate to forming a portion of an article of footwear using an adjustable width roller. The roller may adjust to a particular portion of an article or it may adjust to a known dimension of the article, in aspects. The roller may then roll across a portion of the article to apply a compressive force that forms or shapes the article. The forming/shaping may be enhanced by an application of vibrational energy, thermal energy (e.g., heat), and/or steam to the article. The roller may be moved by a robotic mechanism with a programmed or sensed tool path, in an exemplary aspect.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative aspects are described in detail below with reference to the attached drawing figures, which are incorporated by reference herein and wherein.

DETAILED DESCRIPTION

Figure 3:
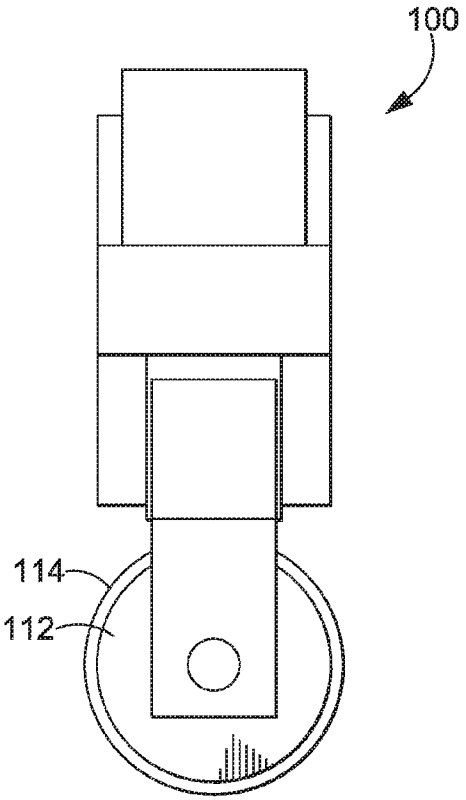
FIG. 3 depicts a side view of the roller assembly, in accordance with aspects hereof.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

Aspects hereof relate to forming a portion of an article of footwear using an adjustable width roller. The roller may adjust to a particular portion of an article or it may adjust to a known dimension of the article, in aspects. The roller may then roll across a portion of the article to apply a compressive force that forms or shapes the article. The forming/shaping may be enhanced by an application of vibrational energy, thermal energy, and/or steam to the article. The roller may be moved by a robotic mechanism with a programmed or sensed tool path, in an exemplary aspect.

Accordingly, in one aspect, an article of footwear manufacturing system is provided having an adjustable width roller. The roller is comprised of a male roller portion that is slidable into a female roller portion of the roller. The male roller portion is comprised of a roller body and a male flange such that the roller body has a smaller diameter than the male flange. The female roller portion is comprised of female flange and a cylindrical receiving portion that is recessed into the female roller portion from the female flange. The female flange has a greater diameter than a diameter of the receiving portion. The roller body is slidable into the receiving portion. The male roller portion and the female roller portion are axially aligned. Aspects also contemplated a vibration device that is effective to generate vibrational energy that is transmitted from the roller to an article of footwear portion.

In another aspect, the present invention provides a method of rolling an article of footwear component with a manufacturing system. The method includes positioning an article of footwear on an article holder of a manufacturing system. The method also includes positioning a roller at a first location on the article of footwear portion and adjusting a distance between a female flange and a male flange of the roller such that a roller body extending between the male flange and the female flange contacts the article of footwear portion at the first location. The method also includes rolling the roller on the article of footwear from the first location to the second location, wherein the roller contact the article of footwear portion as the roller traverses from the first location to the second location. Aspects also contemplate applying vibrational energy to the article of footwear portion. Additionally, it is contemplated that thermal energy and/or steam may be applied by or in conjunction with the roller assembly to aid in the forming/shaping of the article of footwear portion.

Having briefly described an overview of embodiments of the present invention, an exemplary operating environment suitable for implementing embodiments hereof is described below.

Article of footwear may include shoes, boots, sandals, and the like. The term "shoe" will be used herein to generically reference an articles of footwear. It is understood that the term "shoe" is not limited to a traditional style of a shoe, but instead may include a boot, sandal, running shoe, cleat, and other article of footwear. Generally, a shoe is comprised of a ground-contacting portion, which may be referred to as a sole. The sole may be formed from a variety of materials and/or a variety of individual components. For example, a sole may comprise an outsole, a midsole, and/or and insole, as is known in the art. The shoe may also be comprised of a foot-securing portion that is effective to secure a user's foot to the sole. The foot-securing portion may be referred to as a shoe upper, or "upper" for short herein. An upper may be formed from one or more materials and/or one or more individual components. For example, an upper may be formed from a plurality of individual portions that are coupled together through adhesive, stitching, fusing, welding, and the like. Alternatively, the upper may be formed as a unitary member from a common manufacturing process, such as knitting and/or weaving. Other techniques are contemplated for forming an upper and are applicable to the concepts provided herein.

Regardless of the materials or techniques for forming the upper and/or sole, additional shaping and forming may be used to obtain a desired three-dimensional shape. Traditionally, a tooling known as a cobbler's last serves as a shape about which a shoe may be formed to a desired size, shape, and construction. As used herein, the term "last" will reference a form about which an upper may be formed. In some aspects, a sole may be coupled (e.g., adhered, stitched) to the upper as the upper is lasted (i.e., having the last positioned in an interior volume of the upper). The last may define the contours, shape, style, and other characteristics of a resulting shoe.

It is contemplated that one or more portions of a shoe, such as an upper, are physically manipulated with pressure to conform to an underlying last. In addition to pressure, it is contemplated that heat and/or moisture (e.g., steam) may be applied to the shoe portion to further aid in the shaping and forming process. The application of pressure may eliminate wrinkles, creases, and other unintended characteristics of the shoe portion as the shoe portion is formed into a desired configuration. As will be provided herein, it is contemplated that a roller may be effective to apply pressure to a shoe portion to form and cure unintended characteristics of the shoe portion. It is further contemplated that the roller may be heated or have steam associated therewith to further aid in the process in exemplary aspects.

Figure 2:
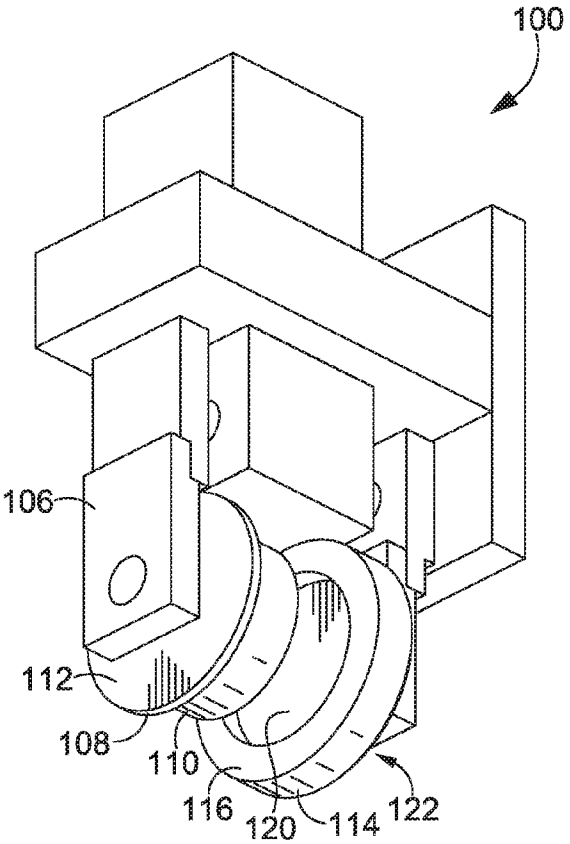
FIG. 2 depicts another perspective of the roller assembly, in accordance with aspects hereof.
Figure 1:
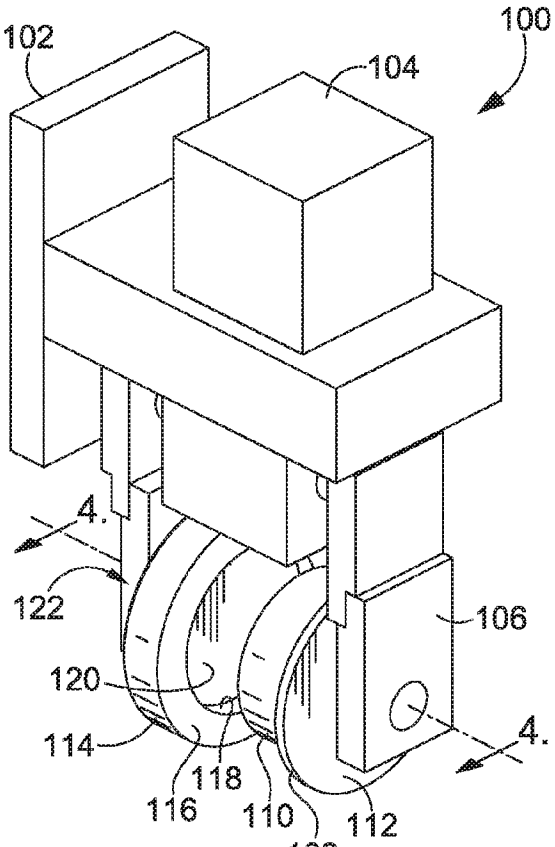
FIG. 1 depicts a first perspective of a roller assembly, in accordance with aspects hereof.

With reference to FIGS. 1-3, a roller assembly 100 is depicted that is functional to apply pressure to a shoe portion, in accordance with aspects hereof. FIG. 1 specifically depicts a first perspective view of the roller assembly 100 comprised of a mounting structure 102, a vibration device 104, a male support arm 106, a male flange 108, a roller body 110, a male roller portion 112, a female roller portion 114, a female flange 116, a female lip 118, a receiving portion 120, and a female support arm 122.

Figure 4B:
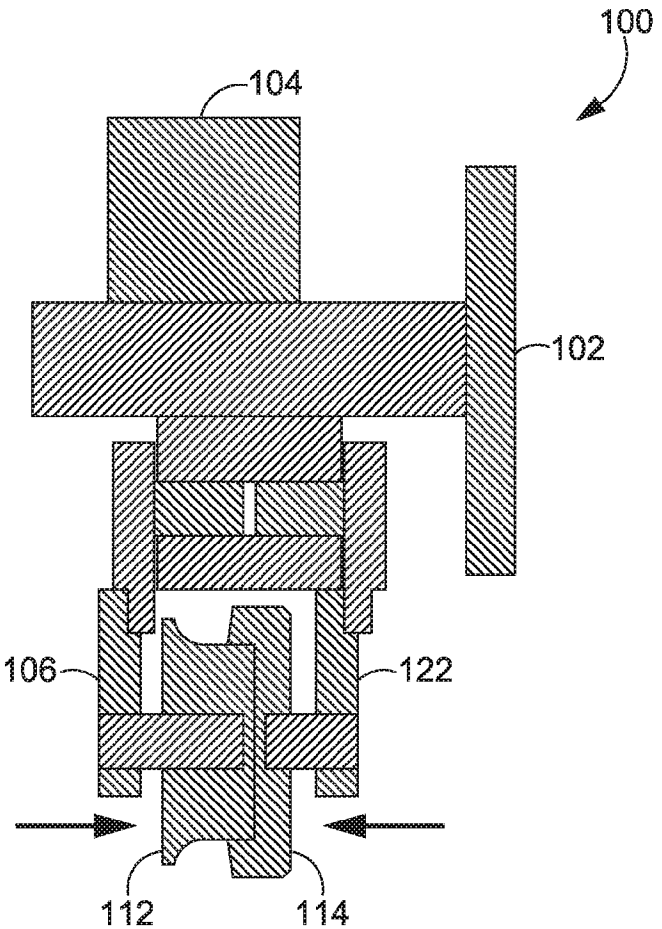
FIG. 4B depicts a cross-sectional view of the roller assembly in a closed width configuration, in accordance with aspects hereof.
Figure 4A:
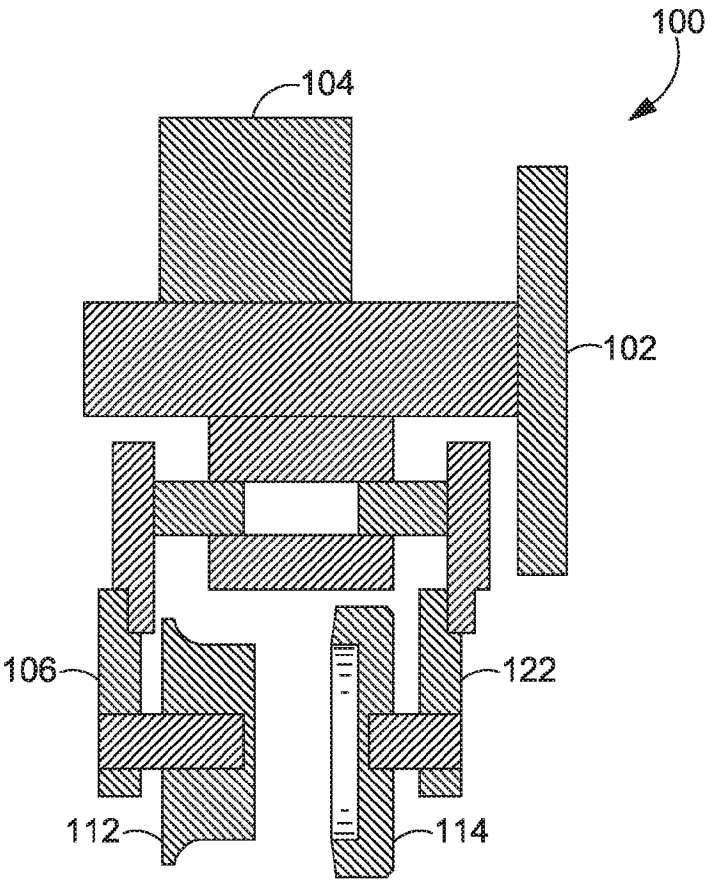
FIG. 4A depicts a cross-sectional view of the roller assembly in an open width configuration, in accordance with aspects hereof.

A roller portion of the roller assembly 100 includes the male roller portion 112 and the female roller portion 114. The roller may be formed from any suitable material, such as metal, ceramics, and/or polymers. The male roller portion 112 is comprised of the co-axially aligned roller body 110 and the male flange 108. The roller body 110 has a first diameter that is less than the diameter of the male flange 108. This difference in diameter will be demonstrated in FIG. 6 hereinafter as the roller assembly 100 rolls across a shoe and the male flange 108 may be useful for providing a compressive force against the shoe portion and guiding a width of the roller as the male portion 112 and the female roller portion 114 slidably engage with each other. The roller body 110 may be effective for engaging the shoe portion (e.g., upper and/or sole) and transferring a compressive force from the roller to the shoe portion to form the shoe portion about the last. It is contemplated that the male roller portion 112 transitions from the roller body 110 to the male flange 108 with a curved profile as seen in FIGS. 4A and 4B. The curved transition may be effective to conform to the shoe portion, such as a top surface of a toe box in a manner better than a non-curved or angled transition may accomplish, in an exemplary aspect.

The female roller portion 114 is comprised of the female flange 116 and the coaxially aligned receiving portion 120 that is depicted as a cylindrical recess into the female roller portion 114. A side wall extending from the female flange surface to the recessed surface of the receiving portion 120 is the female lip 118. The depth of the receiving portion 120 into the female roller portion 114 may be defined by the distance the female lip 118 extends into the female roller portion 114 from the female flange 116 surface. Like the male flange 108, it is contemplated that the female flange 116 engages with and contacts the shoe portion to adjust the slideable interaction of the female roller portion 114 and the male roller portion 112. Further, it is contemplated that the female flange 116 provides a compressive force on the shoe portion to aid in the forming and shaping of the shoe portion. The outside diameter of the female flange 116, in an aspect, is within a range of 30 to 120 millimeters. Further, it is contemplated that the male flange 108 may have a diameter equal to or less than the female flange 116.

The receiving portion 120 of the female flange has a diameter that is equal to or great than the diameter of the roller body 110 at a location of the roller body 110 intended to be received in the receiving portion 120. As such the female roller portion 114 and the male roller portion 112 are slidably engageable such that the roller body 110 extends into the receiving portion 120, as depicted in the FIG. 4B hereinafter. The male roller portion 112 and the female roller portion 114 are also coaxially aligned such that a rotation of the female roller portion 114 when rotatably coupled with the female support arm 122 shares a rotational axis of the male roller portion 112 when rotatably coupled with the male support arm 106. As a result, the male roller portion 112 and the female roller portion 114 may roll or spin as an engaged unit without interfering or binding as a result of an offset or misaligned axis of rotation.

The receiving portion 120 extending inwardly from the female flange 116 allows for the female flange to provide a contacting surface against a shoe portion regardless of an amount of interaction between the roller body 110 and the receiving portion 120. Therefore, as the shoe portion changes, the last is changed, and/or the angle of approach of the roller to the shoe portion, the roller may adjust in width to provide contact between the roller body 110 and the shoe portion, in exemplary aspects. Further, the variable width of the roller allows for the male flange 108 and the female flange 116 to engage with the shoe portion, in exemplary aspects, regardless of if the shoe portion changes, the last is changed, and/or the angle of approach of the roller to the shoe portion is altered.

The male support arm 106 extends from the mounting structure 102 and is effective to support the male roller portion 112. The female support arm 122 extends from the mounting structure 102 and is effective to support the female roller portion 114. While the male support arm 106, the female support arm 122, and the mounting structure 102 are depicted as having a particular configuration, shape, and dimension, it should be understood that any configuration, shape, and dimension may be implemented that allows for aspects contemplated herein to be achieved. For example, the lengths width, and coupling locations of the various components may be altered from the merely illustrative forms presented herein.

It is contemplated that the width of the roller may be adjusted by moving the male support arm 106 and/or the female support arm 122 relative to the mounting structure 102. FIGS. 4A and 4B depict cross-sectional views along line 4 of FIG. 1 in a wide roller configuration at FIG. 4A and in a narrow roller configuration at FIG. 4B. As depicted in the cross-sectional views of FIGS. 4A and 4B the male support arm 106 and the female support arm 122 move relative to the mounting structure 102 to change a width of the roller between the flanges. It is also contemplated that the roller width may additionally or alternatively be adjusted by adjusting a relative position of a roller portion to the respective supporting arm. For example, it is contemplated that the male roller portion 112 may move laterally from the male support arm 106 along a line parallel with the axis of rotation. It is similarly contemplated that the female roller portion 114 may move laterally from the female support arm 122 along a line parallel with the axis of rotation.

The adjustment of the width of the roller may be accomplished by active or passive mechanisms. For example, it is contemplated that one or more actuators may be engaged to move one or more of a support arm and/or a roller portion to adjust a width. It is also contemplated that a biasing mechanism, such as a spring, resists a widening of the roller such that an engagement between the roller and the shoe portion causes the roller width to expand against the force of the biasing mechanism as the flanges interact with surfaces of the shoe portion, in an exemplary aspect. Stated differently, it is contemplated that the shoe portion interacts with the male flange 108 and the female flange 116 to cause the roller body 110 to slide relative to the receiving portion 120 allowing for an expansion of the roller width, in an exemplary aspect.

In addition to adjusting the width of the roller by changing a slideable engagement between roller portions, it is also contemplated that the roller portions themselves may be adjusted and/or changed. For example, based on a shoe style, size, and or shape, alternative roller portions may be used to achieve a desired interaction between the roller and the shoe(s). Specifically, it is contemplated that a first male roller portion and a first female roller portion are used for a first article of footwear, and a second male roller portion and a second female roller portion are used for a different second article of footwear. If, for example, the second article of footwear is smaller than the first article of footwear, the second female and/or male roller portions may have a smaller outside diameter than the first female/male roller portions. Additionally, it is contemplated that different radius may be implemented extending from a roller body to a flange so accommodate a different shaped toe box or other region of a shoe to be manipulated by the roller. As such, it is contemplated that two or more rollers (e.g., combination of male and female portions) may be used on a common assembly to serve different footwear, in an exemplary aspect.

Figure 11:
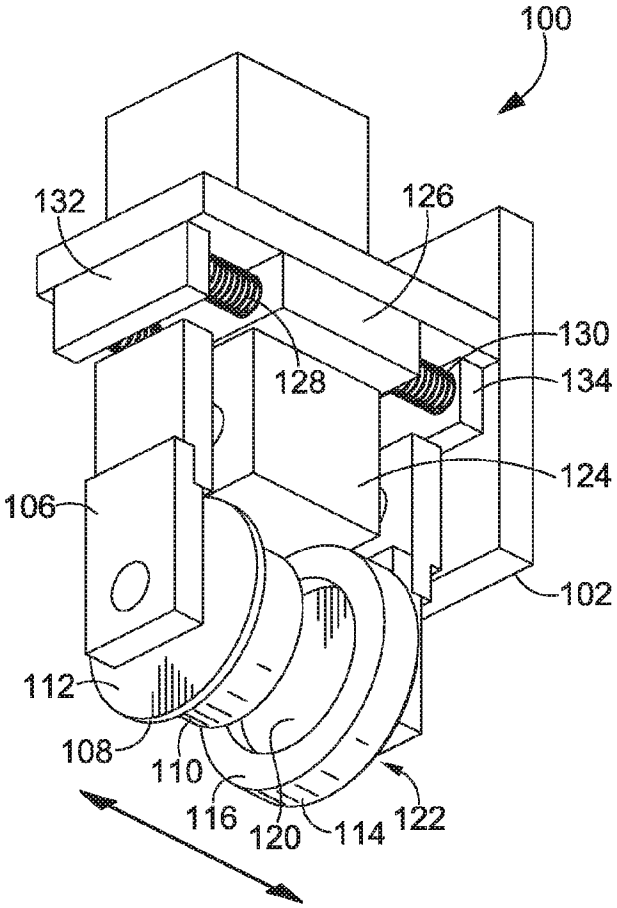
FIG. 11 depicts a perspective of an alternative roller assembly, in accordance with aspects hereof.
Figure 12:
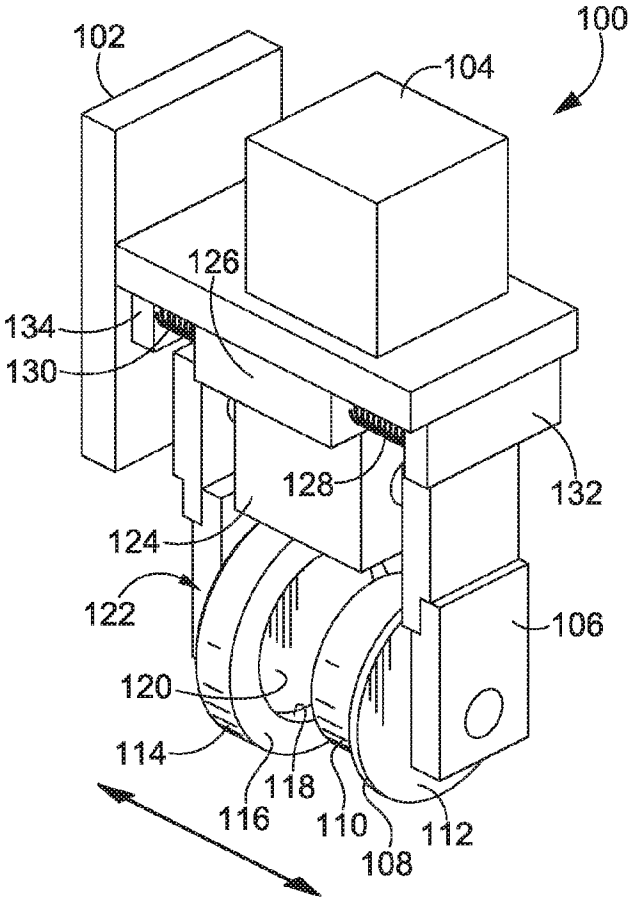
FIG. 12 depicts an alternative perspective of the alternative roller assembly of FIG. 11, in accordance with aspects hereof.

Turning to FIGS. 11 and 12 that depict an alternative roller assembly 100 having a slideable adjusting configuration, in accordance with aspects hereof. In particular, the male support arm 106 and the female support arm 122 are moveably coupled by a passive or active mechanism, as discussed above, with a support arm coupler 124. The support arm coupler 124 may maintain one or more width adjusting mechanism that allow for an adjustment of the roller width. The support arm coupler 124 may be slideable maintained within the mounting structure 102 between support structures 132 and 134. The support structures 132 and 134 are depicted in FIGS. 11 and 12 supporting a plurality of rods 128 and 130 about which a sliding structure 126 is able to slide in a longitudinal direction of the plurality of rods 128 and 130. As a result of this slideable engagement, the support arm coupler 124 that is mounted with the sliding structure 126 is also able to slide in the longitudinal direction of the rods 128 and 130. Therefore, the male roller portion 112 and the female roller portion 114 may move in another axis of motion allowable by the sliding structure 126 to accommodate different shoe positions and orientations while still having the rollers engage the shoe in an intended manner. As further depicted, one or more springs (or other biasing mechanisms) may be used in conjunction with the various structures (e.g., rods 128 and 130) to reposition structures in a default position, such as a centered alignment. However, it is contemplated that the sliding structure 126 may be allowed to freely slide along the rods 128 and 130 without resistance from a spring or other biasing mechanism, in an exemplary aspect.

Returning to FIG. 1, the vibration device 104 provides a vibrational energy that may be transmitted from the roller to the shoe portion. The vibration device 104 is depicted as being coupled with the mounting structure 102 to indirectly transmit vibrational energy through the rollers by way of the support arms and mounting structure 102. Additionally or alternatively, it is contemplated that the vibration device 104 may be coupled with the roller portions directly or integrated within one or more roller portions. Therefore, the vibrational energy may be directly transmitted to the roller while limiting or isolating the vibrational energy from other components, such as a movement mechanism, in an aspect hereof.

The vibration device 104 may be based on any mechanism effective for generating a vibrational energy. For example, a pneumatic powered vibration device is contemplated. Additionally and/or alternatively, an electrically powered vibrational device is contemplated. As provided above, the vibrational energy of the vibration device 104 may aid in the forming and shaping of the shoe portion. In an aspect, as the shoe portion, which may be multiple layer of material is to be formed around the toe box region of the shoe, the vibration of the roller as the roller traverses across to toe region smooths (e.g., limits wrinkles, puckers, and creases) and conforms the materials to an underlying last.

The mounting structure 102 is effective to couple the roller with one or more movement mechanisms, as will be depicted in FIGS. 7-9 hereinafter. It is contemplated that any configuration of a mounting structure may be implemented and the configuration may be determined, in part, by the movement mechanism to which the mounting structure is to be coupled. Therefore, the mounting structure is intended as a representative structure and it is not limiting as to the scope hereof.

FIG. 2 depicts an alternative perspective view of the roller assembly 100 from FIG. 1 The roller is in an open configuration that separates the male roller portion 112 from the female roller portion 114 so that the slideable engagement between the roller body 110 and the receiving portion 120 are visible.

FIG. 3 depicts a side plan view of the roller assembly 100, in accordance with aspects hereof. The male flange of the male roller portion 112 is depicted as having a smaller diameter than the female flange of the female roller portion 114, in this exemplary aspect. The difference in diameter may allow for a more effective engagement with the shoe portion, in an exemplary aspect. For example, the larger diameter female flange may be intended to contact a sole or sole-facing portion of an upper that has a less curved profile than the superior (e.g., top of toe box) region of the shoe portion. The smaller male flange having a curved transition may be therefore more adapted to the curved profile to the superior region of the shoe portion, in an exemplary aspect.

Figures 5A, 5B, 5C:
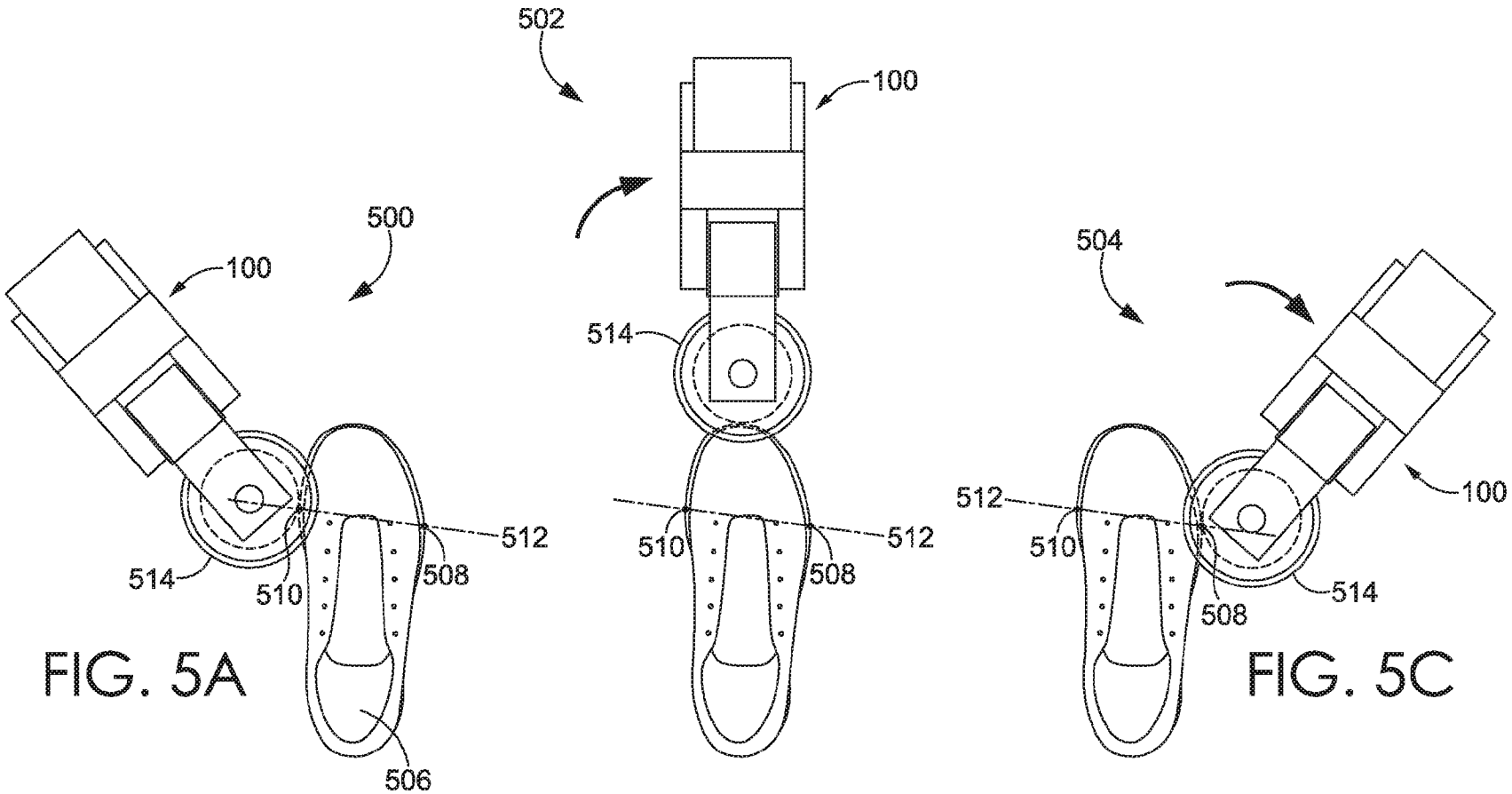
FIGS. 5A-5C depicts a sequence of the roller assembly traversing a shoe portion, in accordance with aspects hereof.

FIGS. 5A, 5B, and 5C depict the roller assembly engaging with an exemplary shoe portion 506, in accordance with aspects hereof. In particular, a roller 514 of the roller assembly is depicted as engaging with the shoe portion 506 from a first location 510 to a second location 508. The roller 514 exerts a compressive force on the shoe portion 506 to form the shoe portion 506, such as around a last (not shown). Additionally, it is contemplated that the roller 514 is effective to aid in bonding a first portion with a second portion, such as a shoe upper with a shoe sole to be coupled with an adhesive. The compressive force of the roller 514 as it rolls from the first location 510 to the second location 508 may compress the materials to aid in a bond being formed between the materials and to shape and conform the materials.

As depicted, a line 512 between the first location 510 and the second location 508 may be referred to as a ball line. The ball line extends through a shoe between a medial apex of the medial side and a lateral apex of the lateral side of the shoe. It is contemplated that the forming of an upper about a last may be accomplished by the roller assembly at least across the toe and to the line 512, in an exemplary aspect. While the first location 510 and the second location 508 are illustrated, it is contemplated that the locations may be anywhere on the shoe, in exemplary aspects.

Position 500 of FIG. 5A has the roller assembly 100 engaging the shoe portion 506 at the first location 510. Position 502 of FIG. 5B has the roller assembly 100 engaging the shoe portion 506 as it traverses to the second location 508 as depicted in FIG. 5C at position 504.

Figure 6:
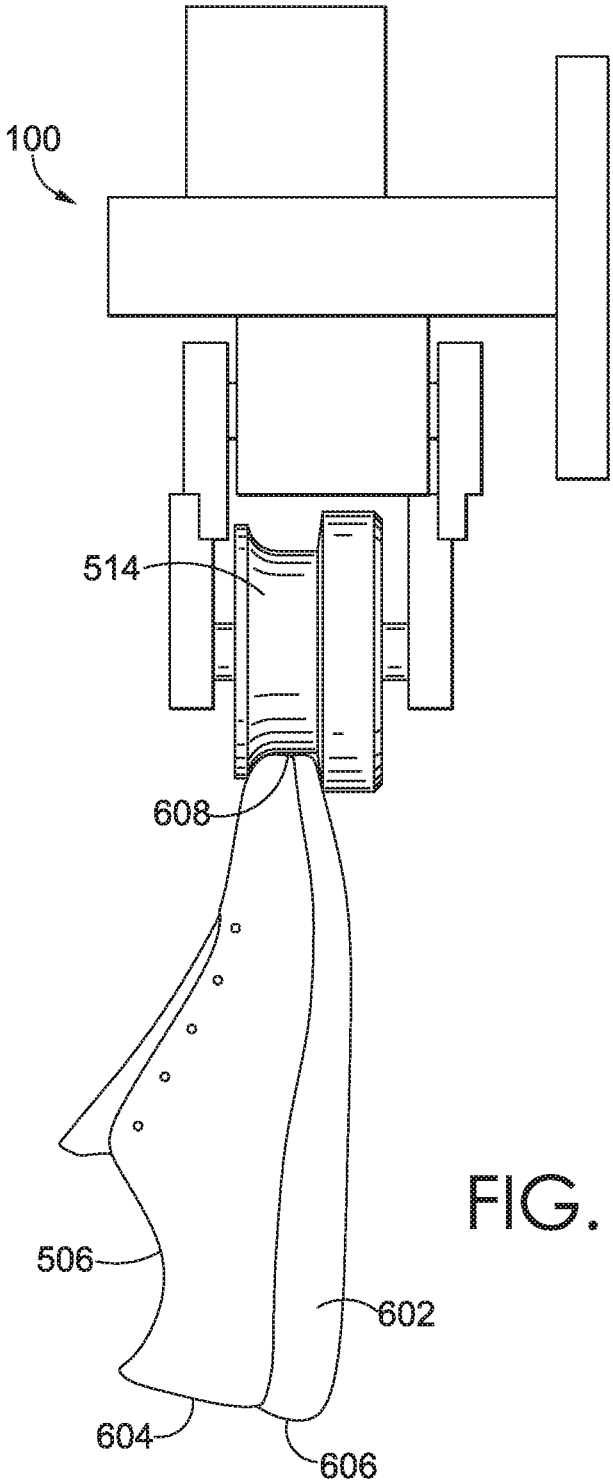
FIG. 6 depicts a side view of the roller assembly engaging with a shoe portion, in accordance with aspects hereof.

FIG. 6 depicts a side profile of the roller assembly 100 engaging with the shoe portion 506, in accordance with aspects hereof. Similar to the position 502 of FIG. 5B, the roller 514 is rolling across a portion of the shoe portion 506 at a toe end 608 that is opposite from a heel end 606. While FIG. 6 depicts the roller engaging with an upper 604 and a sole 602, it is contemplated that instead the roller is engaging with a lasted upper formed from one or more (e.g., multiple) layers to be conformed to the last prior to mating with the sole, in an exemplary aspect. FIG. 6 depicts the male flange engaging with the shoe portion and the female flange engaging with the shoe portion 506. In this illustration, the male flange is engaging with the top of the toe end 608 at the upper 604 and the female flange is engaging with the bottom of the sole 602 at the toe end 608, in this exemplary aspect.

The tool path for the roller assembly to traverse may be programmed and controlled by a movement mechanism as will be discussed hereinafter. Further, it is contemplated that one or more sensors may be used to control or guide the tool path based on a desired compressive force to be applied to the shoe portion. Regardless, it is contemplated that a movement mechanism may move the roller assembly. FIGS. 7-9 depict a manufacturing system 700 comprised of an exemplary movement mechanism 702 for moving the roller assembly 100 in one or more degrees to engage one or more shoe portions 506, 507. The movement mechanism may be any programmable robot, such as a multi-axis, multi-rotational, robot. In an exemplary aspect, it is contemplated that the movement mechanism 702 is comprised of a first linear movement controller 704 that may move in a first axis (e.g., vertical plane). Further, it is contemplated that the movement mechanism 702 is comprised of a second linear movement controller 706 effective to move the roller assembly in another axis (e.g., horizontal plane). Additionally, it is contemplated that a carriage 708 may be coupled with the roller assembly and rotatably controlled by the movement mechanism to provide a rotational component to the movement mechanism 702. FIGS. 7 and 8 depicts a sequence of engagement between the roller assembly 100 and the shoe portion 506 being maintained by an article holder 710. As the roller traverses the shoe portion, the components of the movement mechanism 702 move to allow a tool path to be followed. While specific axes of motion and rotation are depicted as being followed by one or more components (e.g., the roller assembly 100), it is contemplated that additional directions of motion and rotation are implemented. For example, the carriage 708, or other components, may rotate about an X, Y, and/or Z axis, in an exemplary aspect. Further, the carriage 708, or other components, may move about an X, Y, and/or Z axis, in an exemplary aspect. Therefore, it is contemplated that the roller assembly may be rotated and moved in a variety of directions to effectively engage an article of footwear having varied size, shape, and orientation by changing an angle and direction of approach by the roller assembly to the article of footwear.

Figure 7:
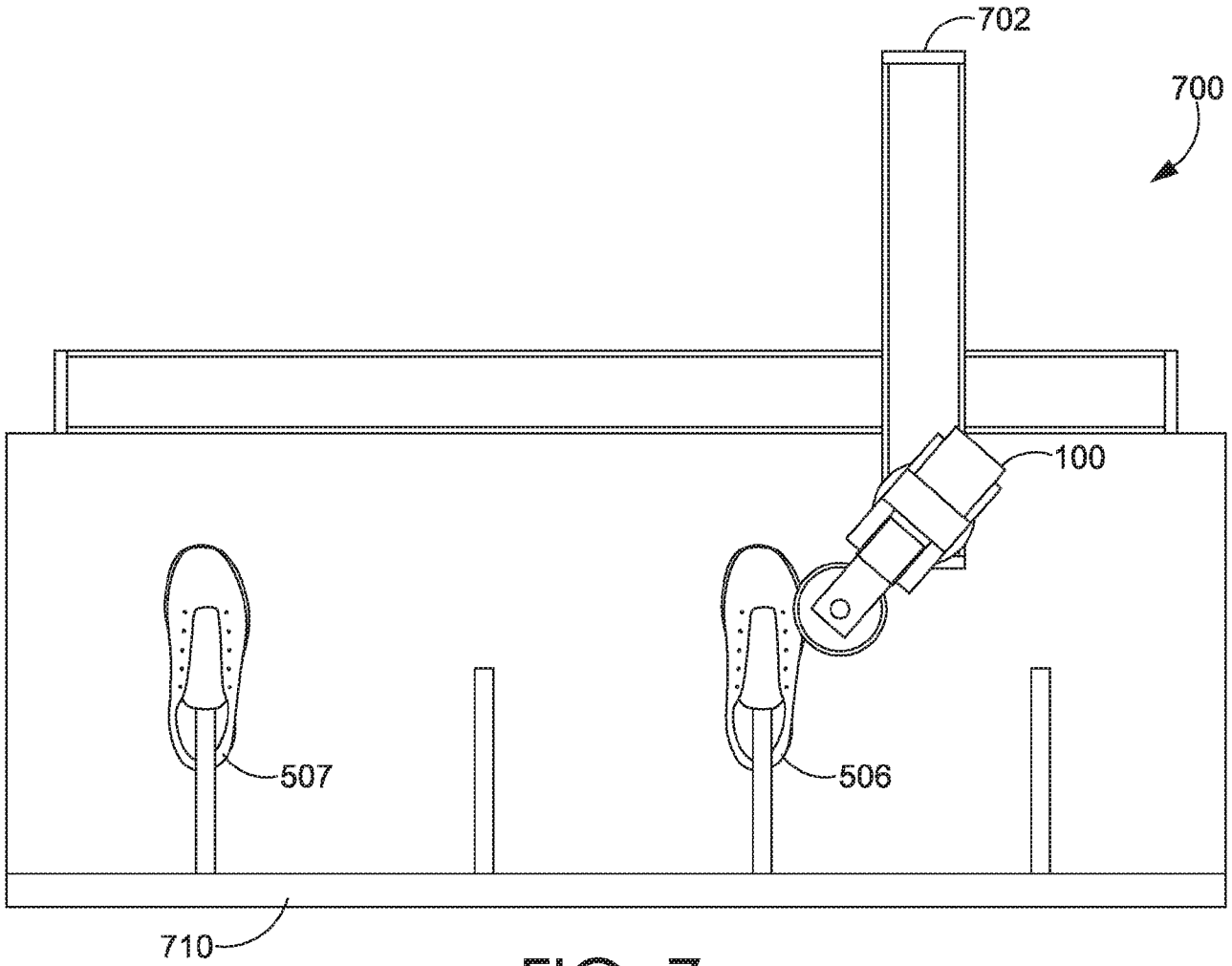
FIGS. 7-9 depict a sequence of a roller assembly engaging with a plurality of shoe portions as moved by a moving mechanism, in accordance with aspects hereof.
Figure 8:
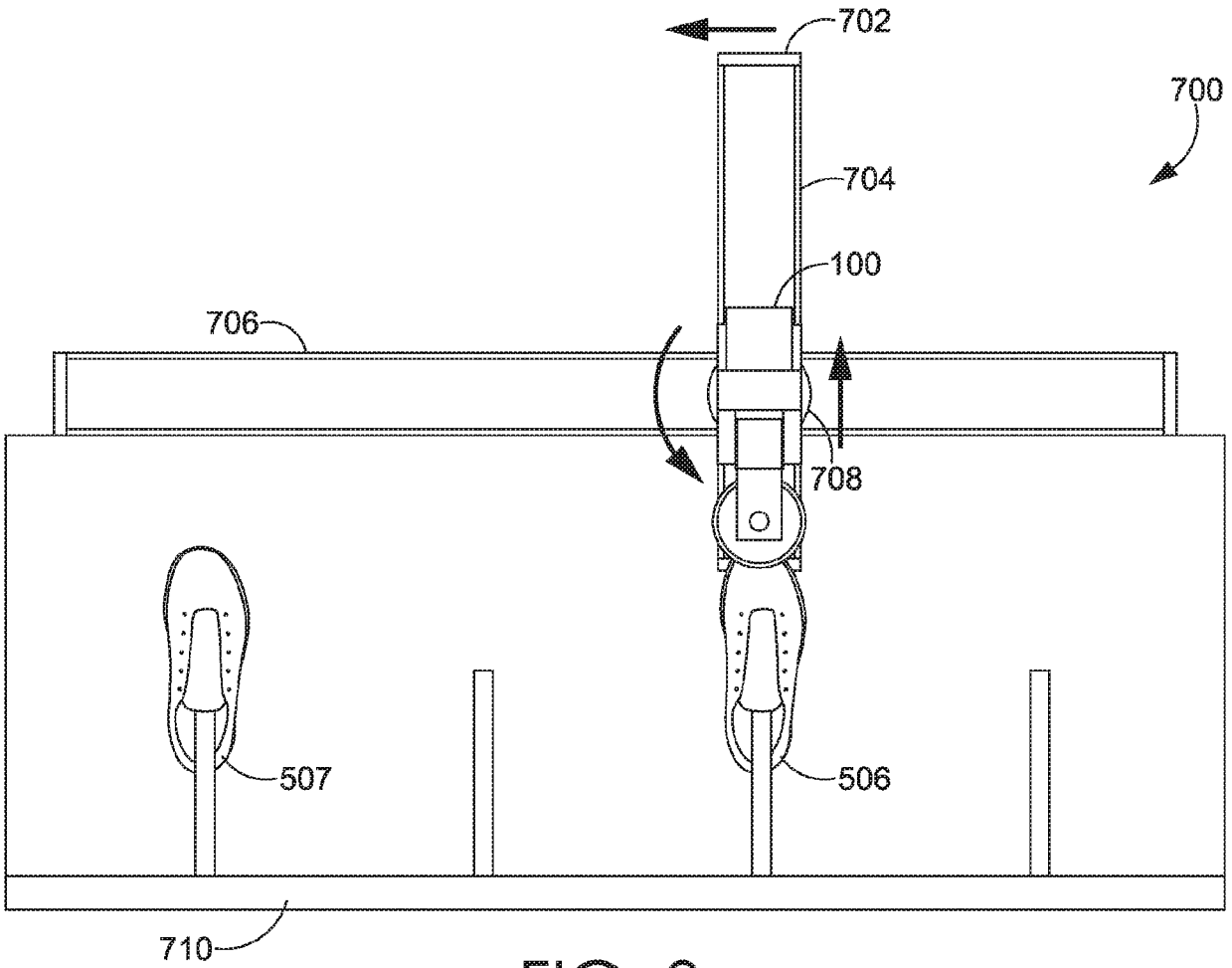
Figure 9:
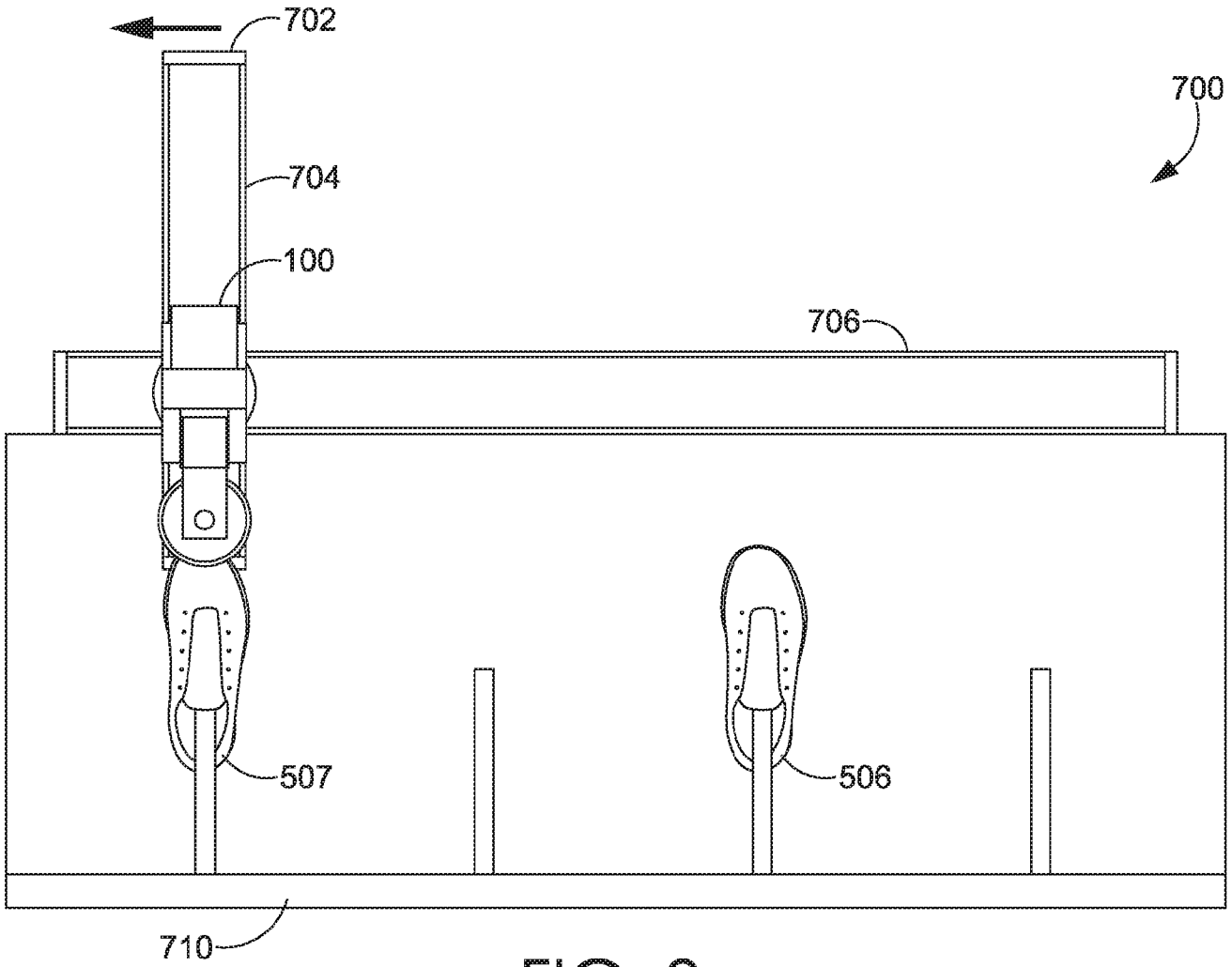

FIG. 9 continues the sequence from FIGS. 7 and 8 to illustrate how a single movement mechanism allows a roller assembly to service multiple shoe portions, such as the second shoe portion 507 maintained on the article holder 710. The article holder 710 may provide known locations for the various shoe portions such that a programmed tool path will be useful for applying the roller assembly 100 to various shoe portions. It is contemplated that the tool path, as discussed above, is programmed for specific shoe portions and/or lasts associate with the shoe portions. For example, a geometry of a last may be known and a tool path, including roller width, may be developed and maintained for controlling the movement mechanism and/or the roller assembly 100 to engage a specific shoe portion/last.

Figure 10:
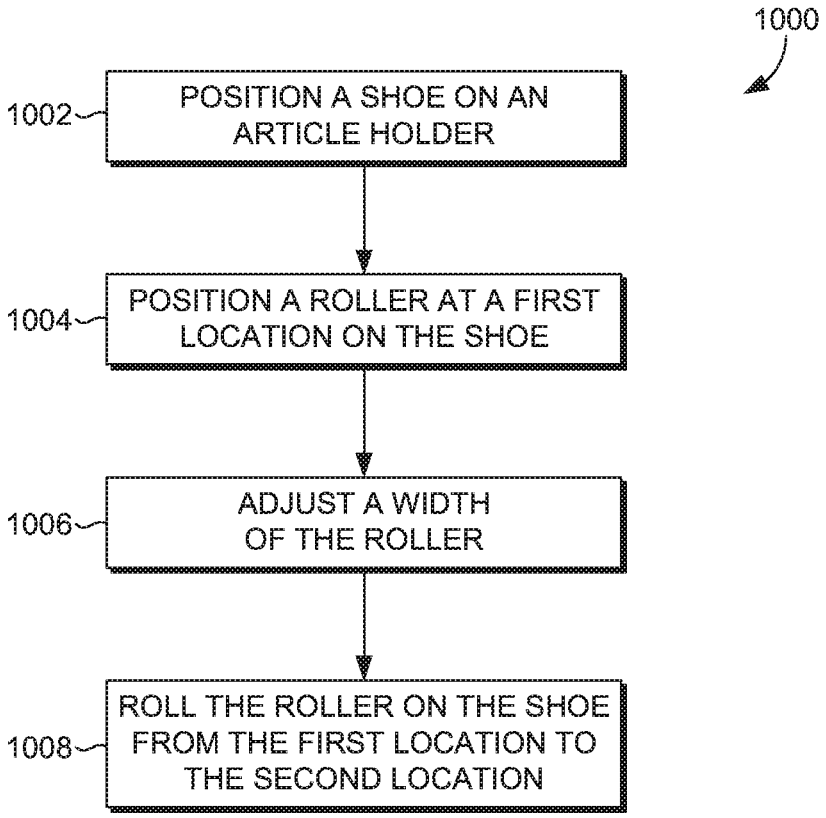
FIG. 10 depicts a flow diagram representing a method of rolling a shoe portion with a manufacturing system, in accordance with aspects hereof.

FIG. 10 depicts a flow diagram 1000 representing a method of rolling a shoe portion with a manufacturing system, in accordance with aspects hereof. At a block 1002 a shoe portion is positioned on an article holder. In an exemplary aspect, the shoe portion is a lasted upper that is secured to an article holding device of the system. It is further contemplated that he shoe portion may be an upper and sole.

At a block 1004, a roller is positioned at a first location of the shoe portion. The positioning of the roller may be accomplished by a movement mechanism controlled by a computer. The roller may be placed in contact with the shoe portion such that one or more portions of the roller provide a compressive force against the shoe portion.

At a block 1006, a width of the roller is adjusted. The adjustment may be controlled by one or more actuators based on a detected or known width associated with the shoe portion. Alternatively or additionally, the width may be determined by the shoe portion expanding a biased width of the roller such that the width is a passive adjustment. The width may be measured as a distance between a male flange and a female flange of the roller. Further, the width may be measured based on a length of a male portion extending into a recessed portion of a female roller portion, in an exemplary aspect.

At a block 1008, the roller rolls along the shoe portion as the roller traverses from the first location to a second location on the shoe portion. As the roller rolls, a compressive force is applied to the shoe portion by way of contact through the roller with the shoe portion. This compression provides a force that extends from the exterior of the shoe portion where the roller contact occurs toward an interior of the shoe portion. The compressive force may be resisted by a last contained therein. The rolling of the roller may be a powered movement of the rollers, such as a motor-assisted rotation. Alternatively, the rolling of the roller may be in response to the movement of the roller assembly and frictional engagement with the shoe portion causing a free-spinning movement of the roller. It is contemplated that vibrational energy may be transmitted from the roller to the shoe portion as the roller rolls across the shoe portion. Further, it is contemplated that steam or other thermal energy may be applied to the shoe portion before or during the rolling of the roller across the shoe portion.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. An article of footwear manufacturing system, the system comprising:

a roller, the roller comprised of a male roller portion that is slidable into a female roller portion of the roller;

the male roller portion comprised of a roller body and a male flange, the roller body having a smaller diameter than the male flange, wherein the male roller portion transitions from the roller body to the male flange with a curved profile;

the female roller portion comprised of a female flange and a cylindrical receiving portion recessed into the female roller portion from the female flange, wherein the female flange has a greater diameter than a diameter of the receiving portion;

the roller body is slidable into the receiving portion, wherein the male roller portion and the female roller portion are axially aligned, wherein the curved profile is positioned between the male flange and the female flange such that the curved profile may engage a shoe upper during a shoe forming process.

2. The system of claim 1 further comprising a male support arm and a female support arm, the female roller portion rotatably coupled with the female support arm and the male roller portion rotatably coupled with the male support arm.

3. The system of claim 2 further comprising a mounting structure, the female support arm and the male support arm adjustably couple with the mounting structure.

4. The system of claim 3, wherein the female support arm and the male support arm adjust in a direction parallel with an axis of rotation for the roller allowing for the roller body to slide within the receiving portion.

5. The system of claim 2 further comprising a vibration device directly or indirectly engaged with the roller.

6. The system of claim 5, wherein the vibration device is coupled with the mounting structure.

7. The system of claim 6 wherein the vibration device is a pneumatic or electric activated vibration generator.

8. The system of claim 2 further comprising a movement mechanism coupled with the mounting structure, wherein the movement mechanism moves in at least one degree of motion.

9. The system of claim 8, wherein the movement mechanism moves in at least three degrees of motion.

10. The system of claim 8, wherein the movement mechanism is comprised of a carriage rotatably engaged with the movement mechanism to rotate the mounting structure supporting the roller.

11. The system of claim 1, wherein the female flange has a diameter between 30 millimeters and 120 millimeters.

12. The system of claim 1, wherein the female flange has a diameter greater than the male flange.

13. The system of claim 1, wherein the roller body has a diameter less than or equal to the receiving portion.

14. The system of claim 1, wherein the roller body extends longitudinally from the male flange at least a distance greater than the receiving portion is recessed into the female roller portion from the female flange.

15. The system of claim 1, wherein the male flange and the female flange are separated by a first distance at a first engagement between the roller body and the receiving portion, the male flange and the female flange are separated by a second distance at a second engagement between the roller body and the receiving portion.

16. The system of claim 1 further comprising an article holder, the article holder maintains one or more article of footwear components relative to the roller.

17. An article of footwear manufacturing system, the system comprising:

a roller, the roller comprised of a male roller portion that is slidable into a female roller portion of the roller;

the male roller portion comprised of a roller body and a male flange, the roller body having a smaller diameter than the male flange;

the female roller portion comprised of female flange and a cylindrical receiving portion recessed into the female roller portion from the female flange, wherein the female flange has a greater diameter than a diameter of the receiving portion; and the roller body is slidable into the receiving portion, wherein the male roller portion and the female roller portion are axially aligned, and wherein the female flange has a diameter greater than the male flange.

18. An article of footwear manufacturing system, the system comprising:

a roller, the roller comprised of a male roller portion that is slidable into a female roller portion of the roller;

the male roller portion comprised of a roller body and a male flange, the roller body having a smaller diameter than the male flange, wherein the male roller portion transitions from the roller body to the male flange with a curved profile, wherein the curved profile is convex an configured to engage a concave portion of a shoe upper;

the female roller portion comprised of female flange and a cylindrical receiving portion recessed into the female roller portion from the female flange, wherein the female flange has a greater diameter than a diameter of the receiving portion;

the roller body is slidable into the receiving portion, wherein the male roller portion and the female roller portion are axially aligned.

* * * * *